United States Patent [19]

Blanchet-Fincher et al.

[11] Patent Number: 4,849,784

[45] Date of Patent: Jul. 18, 1989

[54] METHOD AND APPARATUS FOR HIGH RESOLUTION LIQUID TONER ELECTROSTATIC TRANSFER

[75] Inventors: Graciela B. Blanchet-Fincher, Wilmington, Del.; Kerin S. Benack, Chicago, Ill.; Arthur J. Taggi, Hockessin, Del.

[73] Assignee: E. I. Du Pont de Nemours and Company, Wilmington, Del.

[21] Appl. No.: 117,269

[22] Filed: Nov. 4, 1987

[51] Int. Cl.[4] ..... G03G 15/16

[52] U.S. Cl. ..... 355/274; 355/77; 355/315

[58] Field of Search ..... 355/37 TR, 3 R, 10, 355/14 TR, 77; 430/33, 48, 126, 53, 54

[56] References Cited

U.S. PATENT DOCUMENTS

| | | | |
|---|---|---|---|
| 3,870,515 | 3/1975 | Kaupp | 96/1.4 |
| 3,893,760 | 7/1975 | Thettu | 355/3 TR |
| 3,966,199 | 6/1976 | Silverberg | 355/3 TR |
| 4,060,235 | 11/1977 | Weikel, Jr. | 271/174 |
| 4,146,324 | 3/1979 | Komori et al. | 355/10 |
| 4,171,157 | 10/1979 | Suzuki | 355/3 TR |
| 4,184,870 | 1/1980 | Suzuki | 430/53 |
| 4,190,348 | 2/1980 | Friday | 355/3 TR |
| 4,256,820 | 3/1981 | Landa | 430/54 |
| 4,286,039 | 8/1981 | Landa et al. | 430/119 |
| 4,322,734 | 3/1982 | Ebi et al. | 346/153.1 |
| 4,325,627 | 4/1982 | Swidler et al. | 355/10 |
| 4,363,550 | 12/1982 | Toshimitsu | 430/33 X |
| 4,420,244 | 12/1983 | Landa | 355/3 TR |
| 4,624,543 | 11/1986 | Young et al. | 355/3 R |

OTHER PUBLICATIONS

R. M. Schaffert, "Electrophotography", Focal Press, London, 1975, pp. 476–511.

M. H. Bruno, "Principals of Color Proofing", GAMA Communications, Salem, New Hampshire, 1986, pp. 20–22 and 345, (Appendix D).

*Primary Examiner*—R. L. Moses

*Attorney, Agent, or Firm*—John E. Griffiths

[57] ABSTRACT

A transfer device and method of its use for an electrostatic imaging system using liquid toner capable of generating images having very high resolution at fast speeds. The station includes three sections, an electrically biased tack down roller, a transfer corona station and a transfer medium separator. These sections are located to prevent the onset of turbulence in the liquid toner.

17 Claims, 3 Drawing Sheets

METHOD AND APPARATUS FOR HIGH RESOLUTION LIQUID TONER ELECTROSTATIC TRANSFER

BACKGROUND OF THE INVENTION

1. Field of the Invention

This invention pertains to liquid electrostatic toner transfer stations and more particularly to a transfer station employing corona transfer capable of generating images having very high resolution.

2. Description of the Prior Art

In most instances of electrostatic imaging, the ultimate objective is to produce an image on a carrier sheet having the same appearance, texture and handling characteristics as any other image produced through the printing processes. To obtain this objective, an electrostatically created image is typically covered with toner particles and the toner particles are eventually transferred onto a sheet of paper in imagewise fashion, where they are affixed in a more or less permanent manner. Such electrostatic image producing or image reproducing apparatus is well known in the art. Also well known in the art are methods for transferring the toner particles onto a plain sheet of paper using either pressure rollers to which a bias potential may be applied, or electrical fields such as created by a corona wire to deposit charges on the back side of the paper and attract on its front surface charged toner particles from a toner developed image carrier surface.

The toner particles may be available either as a dry powder, or as a liquid suspension. An electrostatic imaging system, employing both toner particles in a liquid suspension and a corona transfer station is shown in U.S. Pat. No. 4,256,820 issued to Benzion Landa.

In the aforementioned patent, the transfer station is shown schematically as comprising a tack down roll which presses the transfer paper onto the toned surface of a photoconductive drum. The roll is followed by two corona wires in a shielded case. When a voltage is applied to the wires, toner particles are attracted from the surface of the photoconductive drum to the surface of the transfer paper. Paper separating means are available after the corona to pull the paper away from the drum.

While electrostatic copying has found great success, the electrostatic imaging process has shown limitations when applied to certain fields, such as in the printing industry. It is well known to mount on a drum a pre-exposed plate having imagewise conductive and non-conductive areas and through sequential toning and transfer to print multiple copies of the same image much as a printing press does. However, unless very slow printing speeds are employed, the high resolution needed in the printing industry has been beyond the capabilities of the electrostatic printing systems and apparatus.

Specifically, corona transfer resolution, as practiced heretofore, typically provides resolution of the order of 9 lines/mm. In contrast high quality proofing images used in the printing industry require a minimum resolution of 50 to 60 lines/mm or 1% to 99% dots in a 133 lines/inch screen. The term "lines/mm" is defined as a combination of lines and space, also sometimes referred to as line pairs/mm. A detailed description of resolution measurements will be found in pages 476–511 of "Electrophotography" by R. M. Schaffert, published by Focal Press, London, 1975. Definitions of screens, dots and percentage areas as used by the graphic arts industry can be found in "Principles of Color Proofing" by M. H. Bruno, published by GAMA Communications, 1986. While liquid toners tend to produce higher resolution images, corona transfer of thin toner layers showed cracking and mottling of shadow dots and solid areas. These defects degrade the image resolution to an unacceptable level. And while great improvements are obtained when slow speed, i.e., less than 0.5 inches per second, is used in the image transfer stage, such low speed is commercially unacceptable; a higher speed is required. A minimum of 2.2 inches per second is required for some commercially viable systems.

SUMMARY OF THE INVENTION

The objective of the present invention is to provide an improved corona transfer station for liquid toner transfer which achieves high resolution image transfer at speeds of or exceeding 2.2 inches per second. High resolution is resolution adequate for use in the printing industry and particularly in proofing applications.

The above objective has been achieved through the use of a corona transfer station comprising an electrically biased tack down roller, a transfer corona wire and a paper separator means each located adjacent the other along a path along which travel a transfer paper and a toned image carrying master, the tack down roller positioned along the path to bring into mutual contact the transfer paper and the master, the transfer paper and the toned master being in mutual contact along at least a portion of the path, the improvement comprising:

1. a distance between a point on the path at which the transfer paper and the master are first contacted under the bias tack down roller and a projection of the corona wire on the path is no more than 3 inches and preferably about 1.5 inches, and 2. the paper separator means is placed adjacent the corona wire at a distance such that the paper separates from the master at a point in a range of a point under the corona wire to not more than about 15 mm and preferably no more than 5 mm along the path in the direction of the paper travel.

In cases where the path traveled by the transfer paper is a curvilinear path, as when the paper travels along a portion of the outer perimeter of a rotating circular drum on which there is supported an image carrying master, the distances are measured as arc lengths along the perimeter, and all projections are taken at the intersection of the drum perimeter and a radius extending through the desired point from the center of the drum.

In the preferred embodiment, the path of the transfer paper is further controlled such that at the point of the first contact between the master and the transfer paper, the transfer paper forms an angle between itself and the master larger than about 8°.

While specific apparatus for practicing this invention is described, the invention also comprises a method for transferring high resolution toned images from a master bearing a liquid toner layer thereon onto a transfer paper comprising the steps of:

1. contacting the transfer paper onto the toned master without squeegeeing the liquid toner layer from thereinbetween by passing both the paper and the master under an electrically biased tack roller, 2. transferring the toner layer from the master to the paper under the influence of an electric field of opposite polarity to that used for the biasing of the tack roller, and 3. separating the paper from the master the improvement comprising the steps of:

4. transferring the toner layer from the master to the paper before the onset of turbulence in the liquid layer between the master and paper following contacting the paper onto the master, and 5. separating the paper from the master immediately following toner layer transfer and also prior to the onset of turbulence in the liquid layer between the paper and the master.

BRIEF DESCRIPTION OF THE DRAWINGS

This invention will best be understood with reference to the accompanying Figures in which:

FIG. 3 is an enlarged, detailed schematic representation of a second embodiment of a transfer station in accordance with the invention.

DETAILED DESCRIPTION OF THE PREFERRED EMBODIMENT(S)

Figure 1:
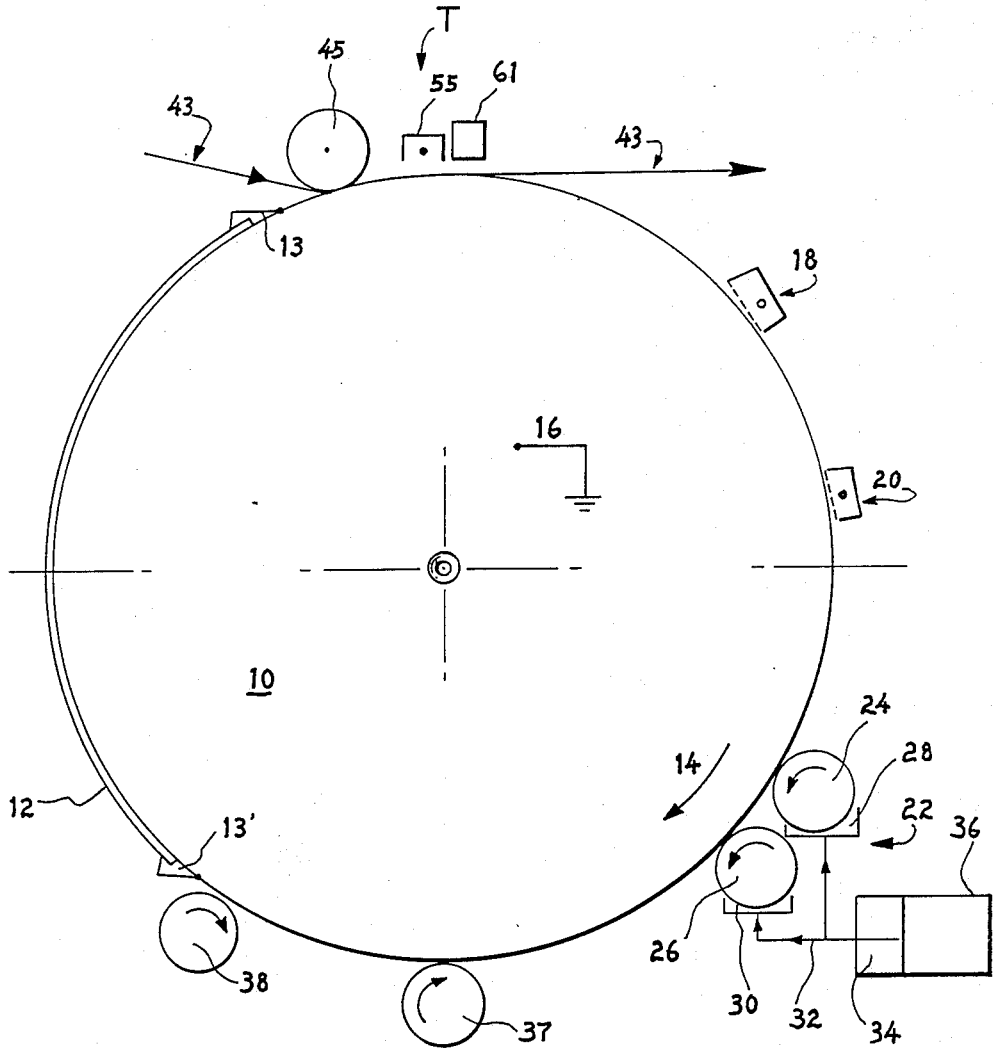
FIG. 1 is a schematic representation of an elevation view of an electrostatic image reproduction apparatus employing a transfer station in accordance with this invention.

In FIG. 1, there is depicted in schematic form an apparatus useful for producing high resolution multiple prints from a plate subjected to previous exposure having areas of varying conductivity in accordance with such pre-exposure.

The apparatus comprises a rotating drum 10 which is rotated in the direction of arrow 14 by means not shown in the Figure and well known in the art. On the surface of the drum there is mounted a master plate or master 12 through the use of any of a number of well-known clamping mechanisms, generally depicted here by numerals 13 and 13'. The master plate 12 has been pre-exposed to a desired image. As a result of this pre-exposure, certain areas in the master 12 have been rendered substantially more electrically conductive than others, in a manner as to reproduce in a latent form the original image.

Along the periphery of the drum 10 are positioned a number of machine elements, typically referred to as stations, which upon command operate to act on the master 12 in any one of a predetermined number of ways. Starting at the upper right hand side there is located a corona charging station 18. Such corona charging stations are well known in the art and the particular design is of no special interest, provided it is able to deposit a charge with a high degree of uniformity on the surface of the master 12. A scorotron having a screen on the side facing the master has been found satisfactory.

Proceeding clockwise, there is a second corona device, referred to as a discharge station 20. This may also be a scorotron of similar structure as the one used in station 18, but to which is applied an A.C. voltage to uniformly neutralize the remaining charges on the master 12 following image transfer and provide a background of very low charge level on the master 12.

A toning station 22 follows the discharge station 20. It comprises one and preferbly two rotating rollers 24 and 26 which rotate partially immersed in liquid toner trays 28 and 30, respectively. The direction of rotation of rollers 24 and 26 is shown by the arrows, and is such that their outer surface is turning in the direction of the outer surface of drum 10 where they come into close proximity or contact. Means not depicted for the sake of clarity allow the rollers 24 and 26 to be moved in and out of contact with the drum 10. A toner reservoir 36, pump means 34 and conduit arrangement 32 are aso provided to assure an adequate supply of liquid toner to the rollers.

In the present arrangement, following the toning station, there is placed a metering roller 37 which rotates in a direction such that its surface moves in the opposite direction than that of drum 10 at the point where they face each other. The purpose of this roller is to wipe off excess toner from the surface of a toned master. Typically, the surface of this roller is spaced about 0.004 inches from the surface of a plate mounted on the drum 10, but that distance may vary between about 0.002 to about 0.007 inches. Means not shown are also provided to move this roller in and out of proximity with drum 10.

A cleaning station simply depicted as roller 38 is next provided which is used to wipe clean the surface of the master 12 following image transfer and prior to recharging for the next image. No details are shown, but such cleaning stations are well known in the art, and the particular design selected is of no consequence, provided it is adequate to remove any left over toner following image transfer.

A transfer station T is located next in a clockwise direction and comprises three sections. A tack down roller 45, which serves to bring the transfer paper 42 moving along path 43 into contact with master 12, is followed by a transfer corona station 55 and paper separator means 61, each of the sections to be more fully described below.

The drum 10 is typically maintained at ground potential, as shown by numeral 16. Appropriate power supplies and electrical connection means not shown, are available to apply, as desired, bias voltages to stations 18 and 20 as well as to toner rollers 24 and 26.

Figure 2:
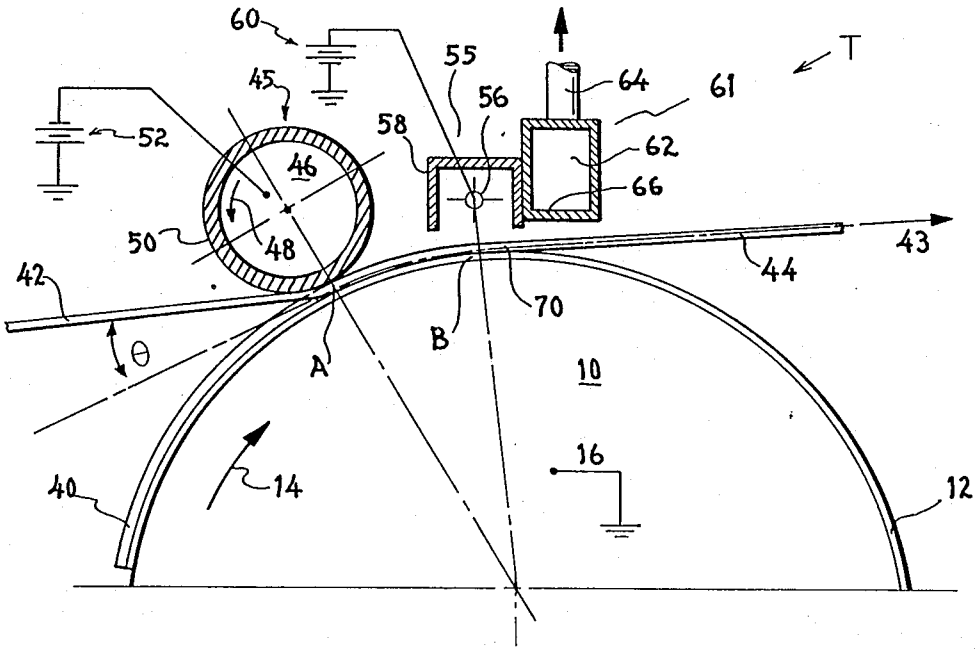
FIG. 2 is an enlarged, detailed schematic representation also in elevation view of a transfer station in accordance with this invention.
Figure 1:
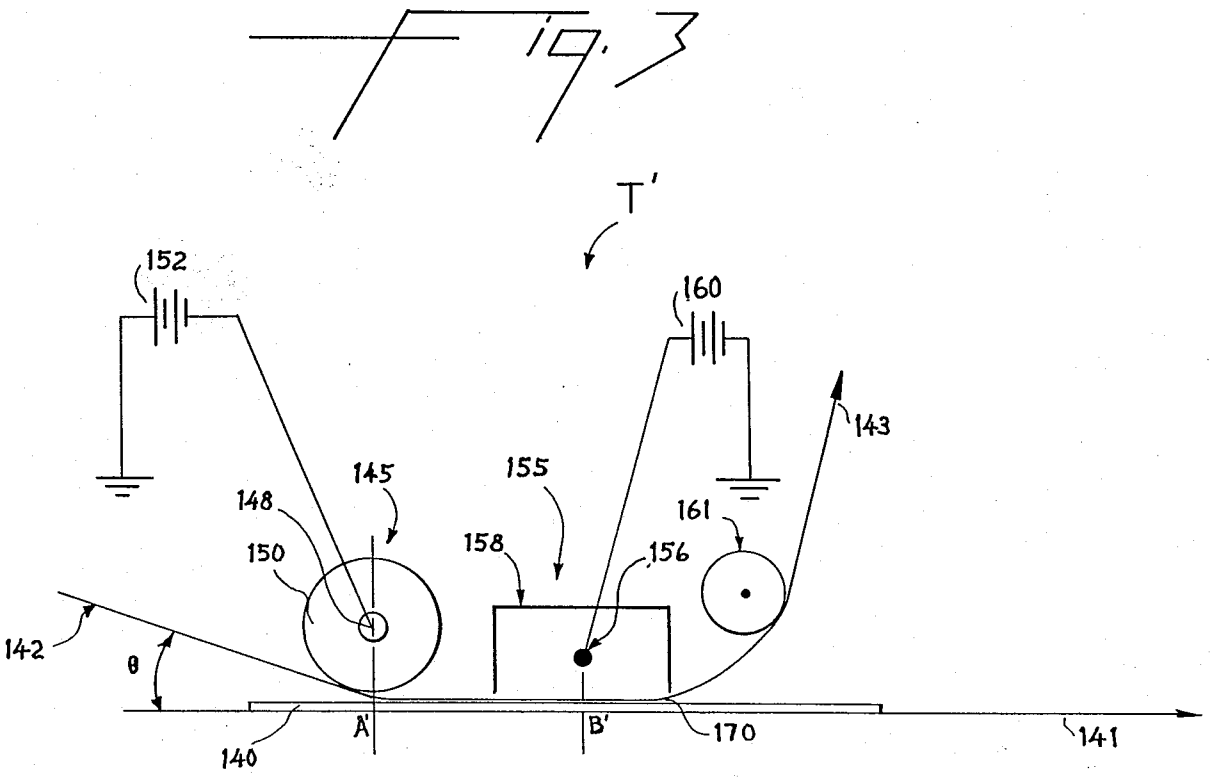

Reference is next made to FIG. 2, which depicts in greater detail the critical elements in the transfer station T.

The plate supporting drum 10 is again depicted bearing thereon a master 12 which has on its surface in imagewise fashion a layer 40 of liquid toner, that is toner particles dispersed in a liquid. In this Figure the master 12 is shown in such position as it would have after a partial transit through the transfer station T. Similarly, part of a sheet of transfer paper 42 is depicted through the transfer station T along path 43 traveling in a direction indicated by the arrow head. As is seen at the exit of the transfer station T the layer 40 of toner has transferred to the paper 42 as an image layer 44.

Preferably the tack down roller 45 comprises a core 46, typically of metal, covered with a conductive rubber sleeve 50. By properly selecting the conductivity of the sleeve, current flow may be limited. When negatively charged toner is used, a negative bias potential of between 6.0 KV and 0.0 KV, and preferably between 3.5 KV and 0.5 KV, may be applied. For positively charged toner, a positive potential would be applied. This bias has the effect of contacting the transfer paper 42 onto the toned master 12 without squeegeeing the liquid toner from thereinbetween and creating image distortion and resolution loss. Numeral 52 indicates the bias voltage source employed. Alternatively, a tack down corona can be used instead of the tack down roller 45.

It is recommended, for optimum results, that the paper feed path 43 be selected such that the angle theta, $\theta$, formed between the transfer paper 42 and the master 12 is larger than about 8°. The paper path is designed such that the incoming paper first contacts the roller 45 and then the toned master 12. Where as here, the master 12 is in a curved configuration the angle theta is measured between a tangent plane drawn to the surface of the drum 10 at the point "A" of contact between the transfer paper 42 and the master 12, and a plane tangent to the paper 42 at the same point.

Following the tack roller 45 is the transfer corona station 55 which comprises a corona wire 56 covered by a shield 58. A power supply 60 provides a positive corona potential which is regulated to maintain a plate current flow of between 25 to 300 milliamperes and preferably between 50 to 100 millamperes. The plate current is the total current going to the wire 56 minus the current flowing in the shield 58 back to the power supply. (A positive voltage is selected because of the charge of the toner particles is negative. A negative voltage would be needed for the transfer in the case where a positively charged toner was used. Then the tack down roller potential would also have been selected positive rather than negative.)

It is very important that the corona wire 56 be placed in close proximity to the tack down roller 45. Specifically, when the paper 42 and master 12 travel through the transfer station T at speeds of or over 2.2 inches/-second and if a curvilinear or circular paper path 43 is used because of the use of a drum 10 to support the master 12, as shown in FIG. 2, then the distance measured on the arc-length between point "A", previously defined, and point "B" corresponding to the corona wire projection on the drum surface along a drum radius extending through the wire centerline should be limited to about 1.5 inches but in all instances where high resolution is desired should stay below 3 inches.

Following the transfer corona station 55, there is paper separator means 61. This means may comprise a roller or a bar or as shown here a suction chamber 62 having a suction slot 66 adjacent the transfer paper path 43 to pull the transfer paper 42 away from master 12. The chamber 62 is connected to a vacuum source (not shown) through conduit 64 to provide a suction source.

The position of the separator means 61, not the structure, is critical. The separator means 61 must separate the paper 42 from the master 12 at a point 70 located just below or just past the corona wire 56. Lifting the paper 42 from the master 12 must occur immediately after transfer in order to assure that the transfer process will be completed before the onset of turbulence in the toner layer 40. This practically speaking translates in point 70 being located in a range of the point B, previously defined, under the corona wire 56 to a point no more than about 15 mm and preferably no more than 5 mm along the paper path in the direction the paper travels.

FIG. 3 illustrates another embodiment of a transfer station T' in accordance with the present invention. As in the FIG. 2 embodiment, the transfer station T' comprises a tack down roller 145, a transfer corona station 155 located adjacent the tack down roller 145, and paper separator means 161 located adjacent the corona station 155.

The tack down roller 145 and transfer corona station 155 are identical to and operate the same as corresponding roller 45 and station 55, previously described in relation to FIG. 2. However, in this embodiment a toned master 112 moves relative to and under the transfer station T' along a substantially horizontal path 141 causing a portion of a path 143 where paper 142 is in contact with master 112 to be substantially horizontal. When the paper 142 and master 112 travel through the transfer station T' at speeds of or over 2.2 inches/-second, the longitudinal centerline of the corona wire 156 should be about 1.5 inches and in no instance more than 3 inches away from the longitudinal centerline of the tack down roller 145.

In FIG. 3, the separator means 161 is illustrated as a roller, but it could just as well be a bar or a suction chamber as shown in FIG. 2.

As in the FIG. 2 embodiment, the separator means 161 is positioned to separate the paper 142 from the flat master at a point 170 located at a point "B'" at the intersection of a line through the corona wire centerline perpendicular to the master 112 or just past point "B'" in the direction of travel of the paper 142. Point 170 is located no more than about 15 mm and preferably no more than 5 mm from point "B'".

The length of the transfer zone and the lifting of the paper 42 or 142 immediately after transfer are most critical issues to maintain high resolution. Any wrap of the paper 42 around the master 12 in the FIG. 2 embodiment or any contact of the paper 142 on the master 112 in the FIG. 3 embodiment after transfer results in a smeared, low resolution image. Excessive length of the transfer zone introduces turbulence in the toner layer 40 or 140 and again degrades resolution.

Describing the operation of the FIG. 1 embodiment, an imaged master 12 having imagewise conductive and non-conductive areas is mounted and clamped by clamps 13 and 13' on the drum 10. The drum 10 is rotated and discharge station 20 is activated to place a uniform level charge on the master plate 12, conditioning it for subsequent charging. During the next drum revolution, charging station 18 places a uniform charge over the master surface. The charge is held on the non-conductive portions of the master 12, and leaks through a ground 16 through the conductive portions thereof.

In a third revolution the toner rollers 24 and 26 are brought against the master 12 and toner is attracted to the areas that have retained a charge. Metering roller 37 adjusts the thickness of the toner layer 40 on the master 12. As this revolution continues, the transfer paper 42 is brought together with the toned master 12 under tack down roller 45. The bias voltage on roller 45 provides a charge on the paper 42 which together with the surface tension of the liquid toner is sufficient to hold it in good contact with the master 12. As the paper 42 and master 12 enter the transfer corona field, toner particles flow from the master 12 to the paper 42 under the applied field, effectively transferring the image to the paper 42. Immediately under or past the corona wire 56 the paper 42 is lifted off the master 12 eliminating any risk of smearing.

The discharge scorotron 20 is again activated to discharge the master 12 and as the drum 10 continues its revolution the cleaning station 38 wipes off any residual toner from the plate 12. The process is repeated for the next print.

It has been found that a resolution of at least 50 lines/mm has been maintained through transfers using the above-described apparatus at transfer speeds of paper velocity of 2.2 linear inches per second. At 8 inches per second paper velocity, successful transfers of images with resolution of 1% to 98% dots of a 150 lines/mm screen were obtained.

What is believed to be happening to produce such high resolution is the implementation of a process in which there is maintained laminar flow condition in the liquid toner layer 40 or 140 in the transfer region before image transfer occurs. Thus, it was surprisingly recognized that the source of loss of resolution was turbulence in the fluid layer 40 or 140 while the paper 42 or 142 and master 12 or 112 are held in contact, even though the two are held in fixed position relative to each other in combination with smearing which occurred after the image had transferred. Since a short transfer zone length was found to be essential for good transfer resolution, it was further found that turbulence occurs in the toner layer 40 or 140 between the paper 42 or 142 and the master 12 or 112 because of the geometry of the transfer zone, particularly its length. If transfer can be accomplished before any turbulence occurs, that is, within a path no more than 3 inches, then mottling in the solid portions of the image and smearing is eliminated. Furthermore, separation of the paper 42 or 142 from the master 12 or 112 immediately after the transfer further assures that the whole process is completed before any turbulence occurs.

Those having the benefit of the above teaching may modify and adapt the above apparatus and method in numerous ways well known in the art. While reference is made to a separate master 12 that is clamped on supporting drum 10, it is well within the scope of this invention for the master 12 to be an integral portion of the drum 10 having photoconductive properties, and for the latent image to be created by direct exposure of the drum surface. And while a transfer paper 42 or 142 is described, transfer of the image on any suitable receiving medium is also contemplated, such as cloth, polyester base and the like. Such modifications and adaptations are still to be viewed as part of the invention.

We claim:

1. A transfer device for transferring a layer of toner particles in a liquid medium in imagewise fashion from a master onto a transfer medium traveling along a path, the device including:

electrically biased tack down means for contacting the transfer medium and the master, the tack down means having a centerline;

a transfer corona wire adjacent the tack down means, the wire having a centerline;

a distance between a first point on the path at which the transfer medium and the master are first contacted by the tack down means and a second point corresponding to the closest point in the path to the wire is no more than 3 inches measured along the path;

transfer medium separator means adjacent the wire at a distance from the wire such that the transfer medium separates from the master at a point in a range of the second point through 15 mm along the path in the direction the transfer medium travels; and whereby the toner particles on the transfer medium have a resolution of at least 50 lines/mm.

2. The device as set forth in claim 1, wherein:

the distance between the first and second points is about 1.5 inches.

3. The device as set forth in claim 1, wherein:

the distance between the tack down means centerline and the wire centerline is no more than 3 inches.

4. The device as set forth in claim 3, wherein:

the distance between the tack down means centerline and the wire centerline is about 1.5 inches.

5. The device as set forth in claim 1, wherein:

the path where the master and the transfer medium are in contact is curvilinear.

6. The device as set forth in claim 5, wherein:

the curvilinear path is circular.

7. The device as set forth in claim 1, wherein:

the transfer medium and the master first contact each other at an angle larger than about 8°.

8. The device as set forth in claim 7, wherein:

the angle is measured between a plane tangent to the master at a point of first contact between the transfer medium and the master, and a plane tangent to the transfer medium at the point of first contact.

9. A transfer device for transferring a layer of toner particles in a liquid medium in imagewise fashion from a master onto a transfer medium traveling along a generally flat path, the device including:

electrically biased tack down means having a centerline;

a transfer corona wire having a centerline located a distance from the tack down means centerline;

a transfer medium separator means adjacent the transfer corona wire; and the tack down means, the transfer corona wire and separator means located along, but separated from, the path, the improvement comprising:

the distance is no more than 3 inches; and the separator means is located sufficiently close to the corona wire to separate the transfer medium from the master at a point in a range of a point at the intersection of the path and a line, through the wire centerline perpendicular to the path, through 15 mm along the path in the direction the transfer medium travels.

10. The device in accordance with claim 9, wherein:

the distance is about 1.5 inches.

11. The device in accordance with claim 9, wherein:

the separator means is located so as to separate the transfer medium from the master immediately past the corona wire.

12. A transfer device for transferring a layer of toner particles in a liquid medium in lengthwise fashion from a master onto a transfer medium traveling along a curvilinear path, the device including:

electrically biased tack down means for contacting the transfer medium and the master, the tack down means having a centerline;

a transfer corona wire having a centerline, the wire adjacent the tack down means;

a transfer medium separator means adjacent the transfer corona wire; and the tack down tack down means, the transfer corona wire and separator means located along, but separated from, the path, the improvement comprising:

a first distance between a first point on the path at which the transfer medium and the master are first contacted together by the tack down means and a second point corresponding to the closest point in the path to the wire is no more than 3 inches measured along the path; and the separator means is located adjacent the corona wire at a second distance such that the transfer medium separates from the master at a third point in a range of the second point through 15 mm along the path in the direction the transfer medium travels.

13. The transfer device in accordance with claim 12, wherein:

the path is circular and the first distance is measured along an arc extending between the first point further defined by the intersection of the path and a first radius of the circular path extending to the tack down means centerline and the second point further defined by the intersection of the path and a second radius of the circular path extending to the wire centerline.

14. The transfer device in accordance with claim 12, wherein:

the first distance is about 1.5 inches.

15. The transfer device in accordance with claim 12, wherein:

the transfer medium and the master first contact each other at the first point at an angle larger than about 8°.

16. The transfer device in accordance with claim 15, wherein:

the angle is measured between a plane tangent to the master at the first point and a plane tangent to the transfer medium at the first point.

17. A method for transferring toned, high resolution images from a master bearing a toned high resolution image thereon comprising a layer of a liquid medium containing toner particles onto a transfer medium comprising the steps of:

contacting the transfer medium onto the toned master without squeegeeing the layer of the liquid medium from thereinbetween by passing both the transfer medium and the master under an electrically biased tack down means;

transferring the toner particles from the master to the transfer medium under the influence of an electric field of opposite polarity to that used for the biasing of the tack down means; and separating the paper from the master; the improvement comprising the steps of:

transferring the toner particles from the master to the transfer medium before the onset of turbulence in the liquid layer between the master and transfer medium following contacting the transfer medium onto the master; and separating the transfer medium from the master immediately following toner particles transfer and also prior to the onset of turbulence in the liquid layer between the transfer medium and the master.

* * * * *